US008413958B2

(12) United States Patent
Zhu

(10) Patent No.: US 8,413,958 B2
(45) Date of Patent: Apr. 9, 2013

(54) LIFTER WITH LINKAGE MECHANISM

(76) Inventor: Jianhua Zhu, Zhejiang (CN)

( * ) Notice: Subject to any disclaimer, the term of this patent is extended or adjusted under 35 U.S.C. 154(b) by 0 days.

(21) Appl. No.: 12/532,283

(22) PCT Filed: Mar. 17, 2008

(86) PCT No.: PCT/CN2008/000516

§ 371 (c)(1),
(2), (4) Date: Sep. 21, 2009

(87) PCT Pub. No.: WO2008/119239

PCT Pub. Date: Oct. 9, 2008

(65) Prior Publication Data

US 2010/0108963 A1 May 6, 2010

(30) Foreign Application Priority Data

Mar. 29, 2007 (CN) ..... 2007 1 0067837

(51) Int. Cl.
*B66F 9/06* (2006.01)
*B66F 7/08* (2006.01)
*E04H 6/08* (2006.01)

(52) U.S. Cl. ..... 254/10 R; 254/93 R; 254/93 L; 254/2 B; 254/7 B; 254/10 B; 269/17

(58) Field of Classification Search ..... 254/2 B, 254/2 C, 93 R, 93 L, 7 B, 10 R, 10 B; 414/228, 414/229, 495, 240; 187/211, 231
See application file for complete search history.

(56) References Cited

U.S. PATENT DOCUMENTS 1,029,823 A * 6/1912 Richardson ..... 187/231
2,031,700 A * 2/1936 Fiedler ..... 254/93 R
2,603,454 A * 7/1952 Newton et al. ..... 254/10 C
3,628,209 A * 12/1971 Parent ..... 14/71.1
3,941,257 A * 3/1976 Matsuura ..... 414/233
4,486,140 A * 12/1984 Klaus ..... 414/229
5,035,562 A * 7/1991 Rosen ..... 414/240
5,275,526 A * 1/1994 Moseley ..... 414/495
5,336,031 A * 8/1994 Golan ..... 414/229
6,048,156 A * 4/2000 Huang ..... 414/234
6,357,990 B1 * 3/2002 Moseley ..... 414/495
6,409,455 B2 * 6/2002 Moseley ..... 414/495
7,004,454 B2 * 2/2006 Petrone et al. ..... 254/10 R

* cited by examiner

*Primary Examiner* — Joseph J Hail
*Assistant Examiner* — Joel Crandall
(74) *Attorney, Agent, or Firm* — Global IP Services; Tianhua Gu

(57) ABSTRACT

A lifter with linkage mechanism includes a frame being movably on floor, a lifting mechanism disposed on the upper portion of said frame and a loading plate jointed with the lifting mechanism. The lifting mechanism includes a lifting arm with a lifting driving box. Two four-bar linkage mechanisms are jointed with a first end of the lifting arm, while a second end of the lifting arm is rotatablely jointed with the frame. The frame includes a horizontal base seat and two columns with vertical guiding groove respectively symmetrically disposed on left side and right side of the horizontal base seat. A crossbeam is coupled between two columns. The four-bar linkage mechanism is disposed between two columns, and the four-bar linkage mechanism is respectively jointed with the loading plate and the lifting arm. In the present invention, the loading plate will be well guided and move freely. The structure of the cantalever style loading plate is simple; it is suitably applied in the double-deck parking garage.

6 Claims, 2 Drawing Sheets

LIFTER WITH LINKAGE MECHANISM

FIELD OF THE INVENTION

The present application is the US national stage of PCT/CN2008/000516 filed on Mar. 17, 2008, which claims the priority of the Chinese patent application No. 200710067837.8 filed on Mar. 29, 2007, which application is incorporated herein by reference.

The present invention relates to the field of lifter mechanism, especially to a kind of lifter with linkage mechanism for the object with complex shape and all kinds of cars. The present invention can be used to lift the object and the car in the storehouse, the port and other indoor or outdoor place, especially in the double-deck parking garage at the uptown and public park.

BACKGROUND OF THE INVENTION

At present, the crane or the forklift is mostly used, when the goods or car is to be lifted at the storehouse and at the port. The crane meets with the requirement of function in most of occasion. However, it is very difficult to lift the goods which is required the professional crane and required be packed, and to lift the car or carry the car in short distance.

Nowadays, with the fast development of the automobile industry, a great lot of cars are manufactured and should be carried and stored. At present, the method of carrying in waterway or in land way or in railway is to use the professional conveyance (ex. a big car or a big carriage). Therefore, before the cars are lifted and carried to the conveyance one by one, the cars should be bonded with the professional conveyance through ropes and blocks, being restricted and being packed. So that, the operation of such method of lifting and carrying cars has much trouble, the efficiency of carrying is very low, and it is also very dangerous in the process of carrying.

SUMMARY OF THE INVENTION

It is an object of the present invention to provide a lifter with a multiple-bar linkage and a movable frame.

For achieving this object, the lifter with linkage mechanism comprising:

a frame, being movable on the floor;

a lifting mechanism disposed on the upper portion of said frame including a lifting arm with a lifting driving box, a first end of said lifting arm being pivoted on said frame, and a second end of said lifting arm being jointed with a linkage mechanism, wherein said frame including a horizontal base seat, two vertical columns with vertical guiding groove respectively coupled to two sides of said base seat, and a crossbeam coupled between said two columns;

said linkage mechanism being two four-bar linkage mechanisms, which is disposed between the two columns and jointed with a loading plate and said lifting arm respectively;

a first end of said loading plate and said four-bar linkage mechanism being jointed with said column and being movable along said vertical guiding groove.

Preferably, each four-bar linkage mechanism includes a first bar which is jointed with the lifting arm, a second bar whose first end is rotatablely jointed with the loading plate, a third bar whose first end is rotatablely jointed with a second end of the second bar, a fourth bar whose upper end is rotatablely jointed with a second end of the third bar, an upper wheel is disposed on the upper end of the fourth bar, a lower wheel is disposed on a lower end of the fourth bar, and the upper wheel and the lower wheel are both able to roll along the vertical guiding groove.

Said four-bar linkage mechanism can make the loading plate lifting up and falling down in balance and in safe. While the upper wheel and the lower wheel which can roll relatively to the vertical guiding groove on the two columns can make the loading plate be well guided and move freely when it is moving up and down, so that the goods or the cars placed on the loading plate will not shake.

Preferably, the upper wheel is rotatablely jointed with the second end of the third bar, while the lower wheel is pivoted on the first end of the loading plate. Then the loading plate can slide up and down along the vertical guiding groove under the guiding of the third bar.

Preferably, the second bar is rotatablely jointed on the middle of the loading plate. So that a cantalever style loading plate can be informed. The cantalever style loading plate can better applied in the double-deck parking garage to lift and let the car leave away, it can reduce the area of the place in front of the parking place which is required when the car coming in or out. The second end of the second bar is pivoted on the second of the first bar, to transfer the drive from the first bar to the second bar.

Preferably, the first end of the lifting arm is rotatablely jointed on the middle of the first bar, while the second end of the lifting arm is pivoted on a supporting base for the lifting mechanism. The lifting arm can be firmly supported by the frame through the supporting base for the lifting mechanism.

Preferably, each column is rotatablely jointed with corresponding first bar through a supporting piece fixed on the inner side of the column. The function of the supporting piece is to reduce the force of the first bar directly to the body of the columns. It can make the columns have better rigidity in long-term work and increase the using time.

Compared with the prior art, this present invention has the advantages as below:

1. The loading plate will be well guided and move freely, and the action of lifting is in balance and in safe.

2. The structure of the cantalever style loading plate is simple, it is suitably applied in the double-deck parking garage to lift and let the car leave away, it can reduce the area of the place in front of the parking place which is required when the car coming in or out.

3. The columns have better rigidity work and the using time of the lifter of the present invention is much longer.

DETAILED DESCRIPTION OF THE INVENTION

In the lifter with linkage mechanism of the present invention, a unique movable frame with short horizontal base seat and a cantalever style loading plate with lifting mechanism which is jointed with the frame and can rise and fall are designed.

Figure 1:
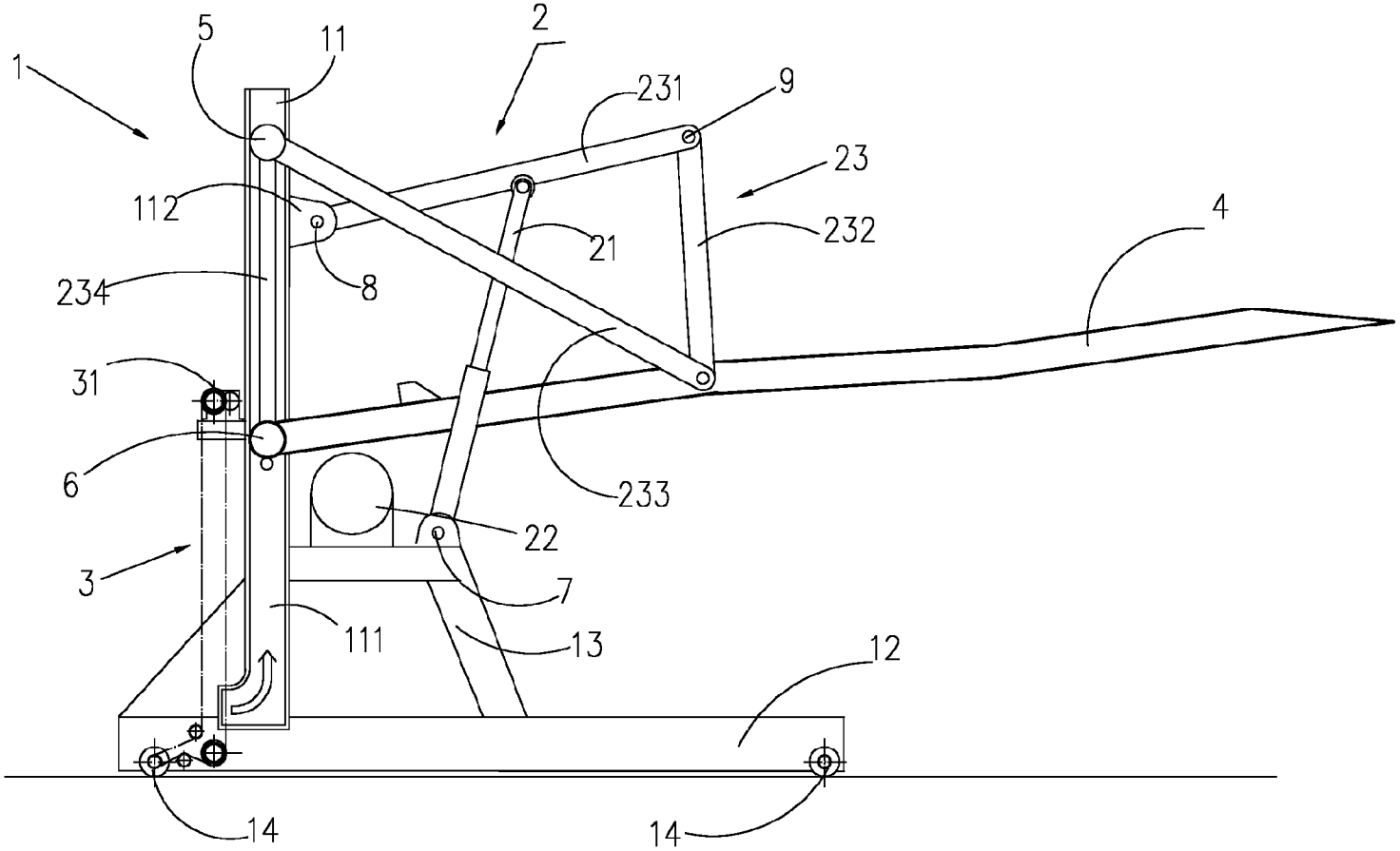
FIG. 1 is a view of the lifter with linkage mechanism in accordance with an exemplary embodiment of the present invention.
Figure 2:
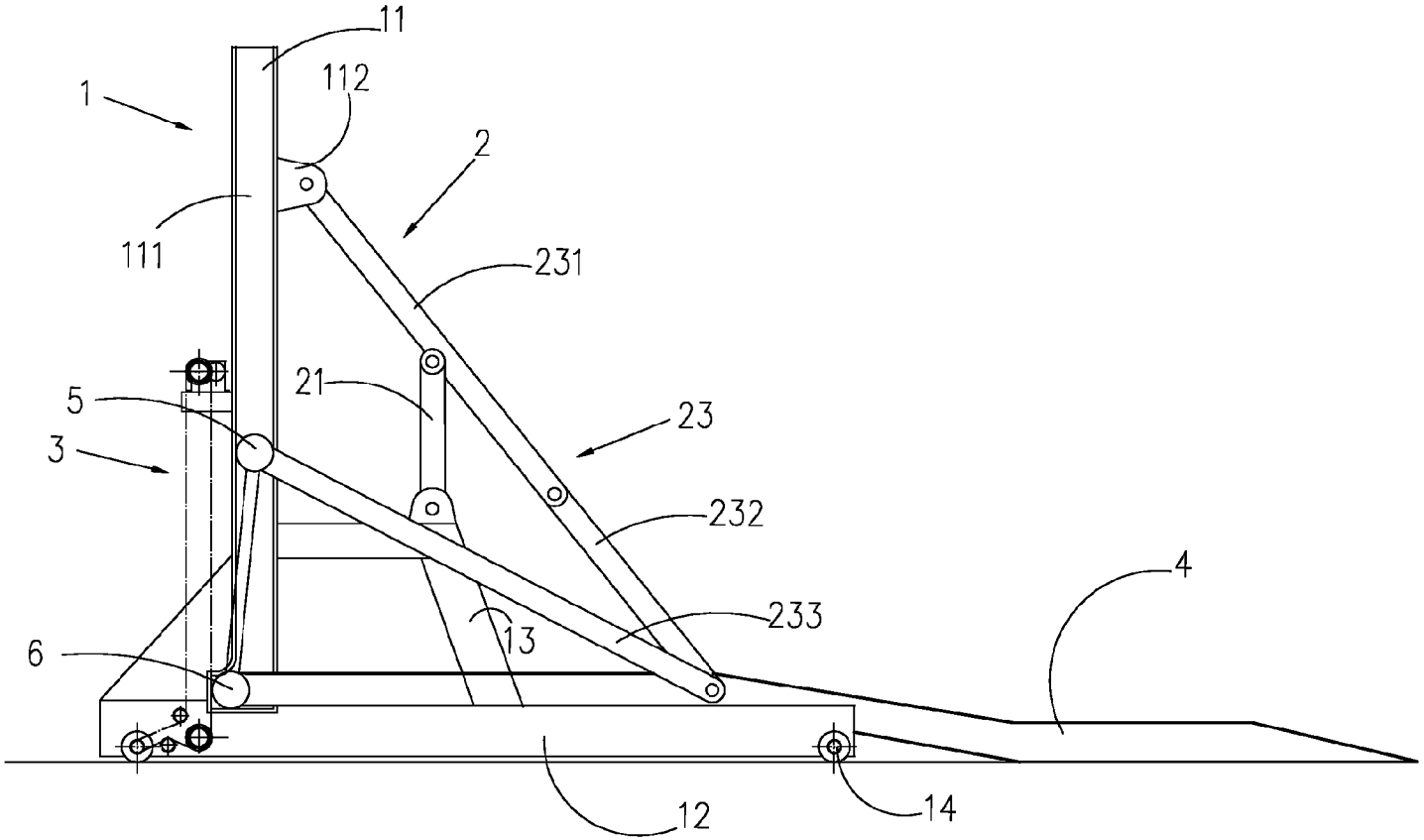
FIG. 2 is a view of the lifter with linkage mechanism of the present invention when the cantalever style loading plate moves down.

To enable a further understanding of the innovative and technological content of the invention herein, refer to the detailed description of the invention and the accompanying drawings below:

FIG. 1 and FIG. 2 show an embodiment of the present invention.

In this embodiment, the lifter comprises a frame 1, being movable on the floor. The frame 1 includes a horizontal base seat 12, two vertical columns 11 with vertical guiding groove 111 respectively coupled to the two sides of said base seat 12, and a crossbeam (not shown in figures) coupled between the two columns 11. These two columns 11 and the crossbeam form a door-style frame.

A lifting mechanism 2 is disposed on the upper portion of the frame. The lifting mechanism 2 is jointed with a cantalever style loading plate 4. The two sides of the cantalever style loading plate 4 are respectively jointed with two columns 11.

The lifting mechanism 2 includes a lifting arm 21 with lifting driving box 22. A four-bar linkage mechanism 23 is jointed with a first end of the lifting arm 21, while a second end of the lifting arm 21 is jointed with the frame 1 through a movable pivot 7.

A vertical guiding groove 111 is formed on the inner side of each column 11. An upper wheel 5 and a lower wheel 6 are both able to roll along the vertical guiding groove 111.

The upper wheel 5 is jointed with the four-bar linkage mechanism 23, and the lower wheel 6 is jointed with the end of the cantalever style loading plate 4. The upper wheel 5 is jointed on the middle of the cantalever style loading plate 4 through the four-bar linkage mechanism 23.

A moving mechanism 3 is disposed on the lower portion of the frame 1. The moving mechanism 3 includes a motor, a transmission 21, and four wheels 14 respectively jointed with the transmission 21. Wherein the wheels 14 are respectively disposed on the bottom of the horizontal base seat 12.

The lifting arm 21 with lifting driving box 22 can be a hydraulic-cylinder-style lifting arm in fluid drive also can be a cylinder toothed bar engaged with a gear drive box.

The four-bar linkage mechanism 23 includes a first bar 231 which is rotatablely jointed with a first pivot 8 fixed on the column 11, a second bar 232 whose second end is rotatablely jointed with a second end of the first bar 231 through a second pivot 9, a third bar 233 whose first end is rotatablely jointed with a first end of the second bar 232 through a third pivot 10, and a fourth bar 234 whose upper end is rotatablely jointed with a second end of the third bar 233 through the upper wheel 5.

The second bar 232 and the third bar 233 are jointed on the middle of the cantalever style loading plate 4 through the third pivot 10. The function of the third bar 233 is to guide the loading plate 4 to slide up and down.

A lower end of the fourth bar 234 is rotatablely jointed with the lower wheel 6. Then the fourth bar 234 will slide up and down in the vertical guiding groove 111 under the rollability of the upper wheel 5 and the lower wheel 6.

The four-bar linkage mechanism 23 can make the loading plate 4 lifting up and falling down in balance and in safe. While the upper wheel 5 and lower wheel 6 which can roll relatively to the vertical guiding groove 111 on the two columns 11 can make the loading plate 4 be well guided and move freely when it is moving up and down, so that the goods or the cars placed on the loading plate 4 will not shake.

A first end of the first bar 231 is rotatablely jointed with the top of the column 11 through the first pivot 8.

The third bar 233 is jointed on the middle of the cantalever style loading plate 4 through the third pivot 10, and then the cantalever style loading plate 4 is formed. Such cantalever style loading plate 4 can better applied in the double-deck parking garage to lift and let the car leave away, it can reduce the area of the place in front of the parking place which is required when the car coming in or out.

The lifting arm 21 with the lifting driving box 22 is fixed on the base seat 12 through a supporting base 13 which supports the lifting arm 21 firmly on the frame 1.

The rotatablely joint of the first bar 231 and the columns 11 is through a supporting piece 112 disposed in the columns and the first pivot 8. The supporting piece 112 is to reduce the force of the first bar directly to the body of the columns. It can make the columns have better rigidity in long-term work and increase the using time.

In the lifting action of the cantalever style loading plate 4, the lifting arm 21 with lifting mechanism 22 disposed on the frame 1 will drive the four-bar linkage mechanism 23, and the four-bar linkage mechanism 23 will drive the cantalever style loading plate 4, then the cantalever style loading plate 4 will lift and move up and down along the vertical guiding groove 111 of the columns 11. The vertical guiding groove 111 is to guide the loading plate 4 to move up and down, it also makes the cantalever style loading plate 4 to move in balance, in safe and in reliability.

The lifter of the present invention is just applied for the lifting of the object with complex shape and all kinds of cars, without using the professional crane or packing It not only can lift the object in balance and in safe, but also can carry the object in short distance. And the efficiency of lifting is high, the action of lifting is in safe and reliability, the operation and the using are very simple.

What is claimed is:

1. A lifter with linkage mechanism comprising:

a frame (1), being movable on the floor;

a lifting mechanism (2) disposed on the upper portion of said frame (1), including a lifting arm (21) with a lifting driving box, a first end of said lifting arm (21) being pivoted on said frame (1), and a second end of said lifting arm (21) being jointed with a linkage mechanism; wherein said frame (1) including a horizontal base seat (12), two vertical columns (11) with vertical guiding grooves (111) respectively coupled to two sides of said base seat (12), and a crossbeam coupled between said two columns (11);

said linkage mechanism being two four-bar linkage mechanisms (23), which is disposed between the two columns (11) and jointed with a loading plate (4) and said lifting arm (21) respectively;

a first end of said loading plate (4) and said four-bar linkage mechanism (23) being jointed with said column (11) and being movable along said vertical guiding groove (111);

each of said four-bar linkage mechanism (23) includes:

a first bar (231), which is jointed with the lifting arm (21), a second bar (232), whose first end is rotatably jointed with said loading plate (4), whose second end is pivoted on the second end of said first bar (231), a third bar (233) whose first end is rotatably jointed with a second end of said second bar (232);

a fourth bar (234) whose upper end is rotatably jointed with a second end of said third bar (233), an upper wheel (5) disposed on the upper end of said fourth bar (234), a lower wheel (6) disposed on a lower end of said fourth bar (234), and said upper wheel (5) and said lower wheel (6) are both able to roll along the vertical guiding groove (111).

2. The lifter with linkage mechanism of claim 1, wherein said upper wheel (5) is rotatably jointed with the second end of said third bar (233), while said lower wheel (6) is pivoted on the first end of said loading plate (4).

3. The lifter with linkage mechanism of claim 1, wherein said second bar (232) is rotatably jointed on the middle of said loading plate (4).

4. The lifter with linkage mechanism of claim 1, wherein the first end of said lifting arm (21) is rotatably jointed on the middle of said first bar (231), while the second end of said lifting arm (21) is pivoted on a supporting base for said lifting mechanism.

5. The lifter with linkage mechanism of claim 1, wherein each said column (11) is rotatably jointed with corresponding said first bar (231) through a supporting piece (112) fixed on the inner side of said column (11).

6. The lifter with linkage mechanism of claim 1, wherein the lifter includes a driving device to make said frame (1) move on the floor.

* * * * *